US008303003B2

(12) United States Patent
Berghahn et al.

(10) Patent No.: US 8,303,003 B2
(45) Date of Patent: Nov. 6, 2012

(54) LATCH FOR A VEHICLE

(75) Inventors: Jörg Berghahn, Gelsenkirchen (DE); Hans-Günter Kaiser, Wuppertal (DE); Jürgen Moczygemba, Reutlingen (DE); Eckart Schuler, Sindelfingen (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 388 days.

(21) Appl. No.: 12/312,380

(22) PCT Filed: Oct. 26, 2007

(86) PCT No.: PCT/EP2007/009294

§ 371 (c)(1),
(2), (4) Date: May 7, 2009

(87) PCT Pub. No.: WO2008/055596

PCT Pub. Date: May 15, 2008

(65) Prior Publication Data

US 2010/0045051 A1 Feb. 25, 2010

(30) Foreign Application Priority Data

Nov. 9, 2006 (DE) ..... 10 2006 052 773

(51) Int. Cl.
*E05C 3/06* (2006.01)

(52) U.S. Cl. ..... 292/201; 292/216; 292/DIG. 23

(58) Field of Classification Search ..... 292/201, 292/216, DIG. 23
See application file for complete search history.

(56) References Cited

U.S. PATENT DOCUMENTS

| | | | | | |
|---|---|---|---|---|---|
| 4,298,223 | A | * | 11/1981 | Raffelsiefer et al. | 292/216 |
| 4,814,557 | A | * | 3/1989 | Kato | 200/61.64 |
| 5,020,838 | A | * | 6/1991 | Fukumoto | 292/201 |
| 5,618,068 | A | * | 4/1997 | Mitsui et al. | 292/201 |
| 5,632,517 | A | * | 5/1997 | Paulik et al. | 292/341.12 |
| 5,642,636 | A | * | 7/1997 | Mitsui | 70/237 |
| 5,765,884 | A | * | 6/1998 | Armbruster | 292/216 |
| 5,836,639 | A | * | 11/1998 | Kleefeldt et al. | 296/155 |
| 5,876,074 | A | * | 3/1999 | Dowling | 292/201 |
| 6,003,910 | A | * | 12/1999 | Dupont et al. | 292/201 |
| 6,053,543 | A | * | 4/2000 | Arabia et al. | 292/201 |
| 6,305,727 | B1 | * | 10/2001 | Bland | 292/216 |

(Continued)

FOREIGN PATENT DOCUMENTS

DE 27 28 042 1/1979

(Continued)

*Primary Examiner* — Kristina Fulton
(74) *Attorney, Agent, or Firm* — Lucas & Mercanti, LLP; Klaus P. Stoffel

(57) ABSTRACT

The invention relates to a latch that comprises a lock and a closing part that engages with the latter. Said lock comprises a catch (10) and a clink and said catch (10) comprises a receiving element (19) for the closing part and has a stepped profile in the direction of the periphery, said stepped profile having a prestop (13) and a main stop (14) for a locking point on the clink. Said catch (10) can be adjusted at least between three rotational positions which are an open position, a stop position and a main stop position. In order to prevent problems with the latch, the prestop (13) and the main stop (14) are placed on the catch (10) at a radial distance (47, 48), that is different from each other, in relation to the rotational axis (11). A sensor determines the different radial distance that is obtained in the prestop position and the main stop position, and informs the control device. In accordance with the information provided to the sensor, the control device performs the functions defined by vehicle.

16 Claims, 4 Drawing Sheets

U.S. PATENT DOCUMENTS

| | | | | |
|---|---|---|---|---|
| 6,400,278 | B1 * | 6/2002 | Weyerstall et al. | 340/686.3 |
| 6,416,088 | B1 * | 7/2002 | Graute | 292/216 |
| 6,749,234 | B2 * | 6/2004 | Bruce | 292/216 |
| 6,883,839 | B2 * | 4/2005 | Belmond et al. | 292/201 |
| 7,040,674 | B2 * | 5/2006 | Lomicka et al. | 292/201 |
| 7,352,081 | B2 * | 4/2008 | Taurasi | 307/10.1 |
| 7,384,080 | B2 * | 6/2008 | Kachouh | 292/201 |
| 7,789,440 | B2 * | 9/2010 | Graute et al. | 292/216 |
| 2001/0010427 | A1 | 8/2001 | Roos | |
| 2003/0222462 | A1 | 12/2003 | Bruce | |
| 2005/0001437 | A1 * | 1/2005 | Brose | 292/216 |
| 2006/0125245 | A1 * | 6/2006 | Graute et al. | 292/216 |
| 2006/0131894 | A1 * | 6/2006 | Graute | 292/216 |
| 2006/0157989 | A1 * | 7/2006 | Graute | 292/216 |
| 2008/0203737 | A1 * | 8/2008 | Tomaszewski et al. | 292/216 |
| 2010/0117379 | A1 * | 5/2010 | Mitchell et al. | 292/216 |

FOREIGN PATENT DOCUMENTS

| | | |
|---|---|---|
| DE | 102 39 734 | 3/2004 |
| EP | 1 605 118 | 12/2005 |
| EP | 1 637 674 | 3/2006 |

* cited by examiner 53
17
13
38
37
47
55
39
14
54

59
II
10
16
13
45
49
55
17
31
55
57
14
11
15
58
46
47
48
55
18
19
56

LATCH FOR A VEHICLE

The invention concerns a lock mechanism A lock mechanism of this type is installed between a moving part and a stationary part of a motor vehicle, namely, a door or hinged lid, on the one hand, and the vehicle body, on the other hand. A lock is installed on one of the parts, and a closing part, which cooperates with the lock, is seated on the other part of the motor vehicle.

Important components of the lock include a rotatably supported catch and a swiveling latch that is spring-tensioned towards the catch. Interaction of the catch with the latch allows the catch to be placed in at least three rotational positions, namely, an open position, a prelocking position, and a main lock-in position, which will be described in greater detail later. There is a sensor that monitors the prelocking position and signals a control unit, which then initiates certain functions in the vehicle. These functions include, for example, the switching on of a door shutting aid, which moves the rotary catch from its prelocking position to its main lock-in position, in which the door is brought into a final closed position relative to the vehicle body by means of the lock and the closing part.

In practice, it sometimes happens that the rotary catch does not move exactly into one of its three rotational positions, so that the sensor does not respond, and the desired function on the door is not triggered. It is this problem that the invention is intended to address.

The objective of the invention is to develop an inexpensive and highly-reliable lock.

Because the prelocking stop notch and the main stop notch are located at significantly different radial distances with respect to the axis of rotation, the active radial distance can be uniquely determined by a sensor, which then causes the control unit to initiate the desired function. This is especially the case when the radial distance in the respective section of a step profile provided on the catch is constant. A constant radial distance of this type is designed to be present, on the one hand, in an initial section of the step profile before the prelocking stop notch and, on the other hand, in a middle section of the step profile between the prelocking stop notch and the main stop notch.

Although it is possible to determine the radial distance directly on the catch, the invention proposes that this determination be made indirectly via the latch. According to the three different rotational positions of the catch, the latch moves into three analogous swivel positions that are angled differently relative to one another. Because the swivel positions of the latch uniquely reproduce the rotational positions of the rotary catch, the control unit can reliably carry out the desired motorized movements on the rotary catch. Malfunctions are avoided in this way.

Other features and advantages of the invention are described in the dependent claims and the description which follows and are illustrated in the drawings. A specific embodiment of the invention is explained below with reference to the drawings.

Figure 3:
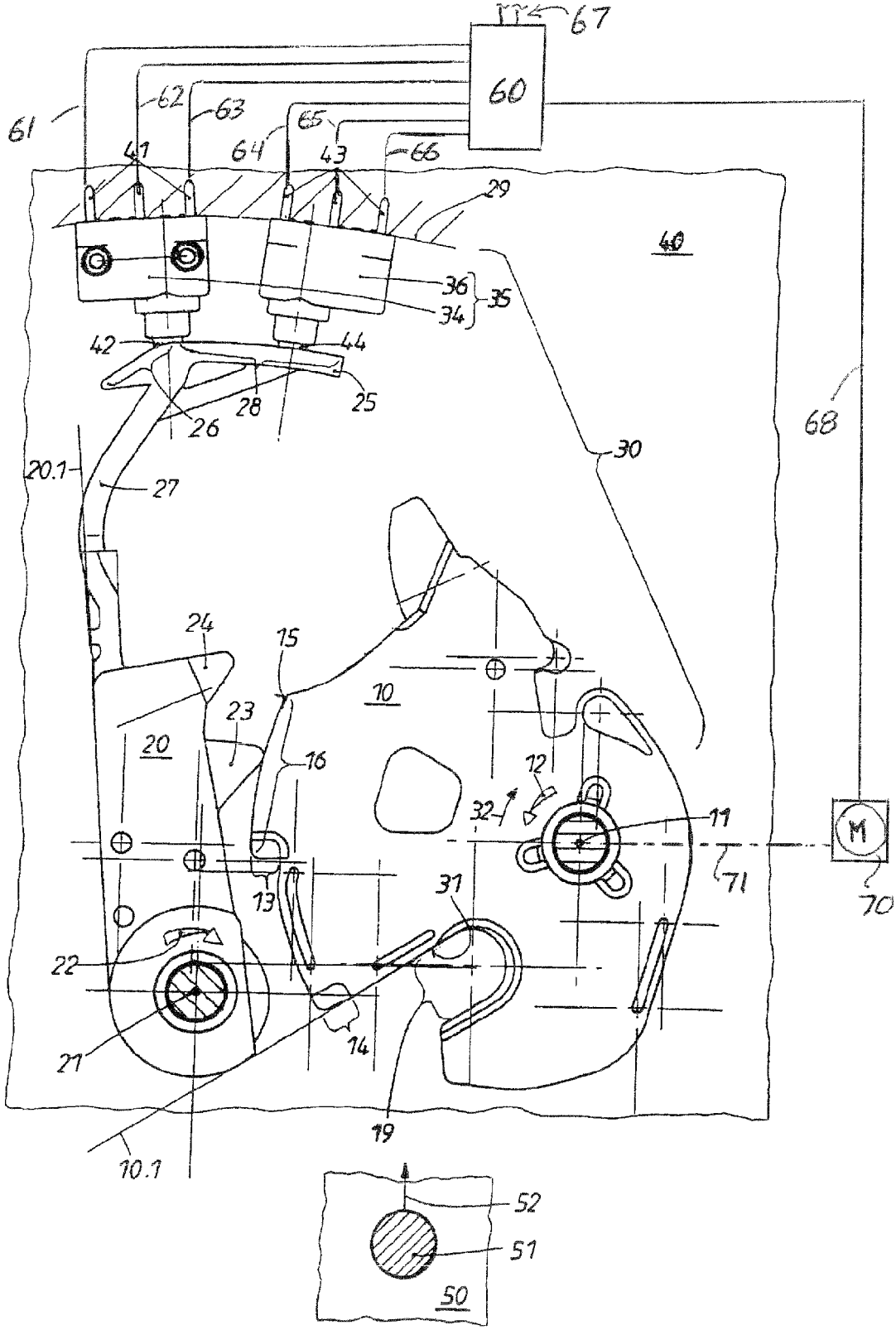
FIGS. 3 to 5 show top views of different positions of the most important components of the lock, in which the catch shown in FIGS. 1 and 2 is located, namely, in an open position of the catch in FIG. 3, a prelocking position in FIG. 4, and a main lock-in position in FIG. 5.

FIG. 3 is a schematic representation of a section 40 of a door with a lock 30 installed in it, in which, as noted above, only the most important components are shown, namely, a catch 10 and a latch 20. The rotary catch 10 is rotatably supported on a stationary axis 11 in a lock housing, the details of which are not shown. The latch 20 also has a stationary axis 21, about which the latch 20 can swivel. Both the catch 10 and the latch 20 are under spring tension by restoring springs (not shown) in the direction indicated by the rotational arrow 12 and the rotational arrow 22, respectively. The spring tension 12 holds the catch 10 in the well-defined first rotational position shown in FIG. 3 by means of a rotary stop (not shown). This first rotational position is designated the "open position" and is indicated by the auxiliary line 10.1 in FIG. 3. In its peripheral area, the rotary catch 11 has a step profile 15, which will be described in greater detail later. The step profile 15 has a prelocking stop notch 13 and a main stop notch 14.

The latch 20 has a locking catch 23 and a supporting catch 24, which cooperate with the step profile 15 of the catch 10 in a way that will be described in greater detail below. The latch 20 is the passive part of the lock 30. It fixes the given rotational position of the catch 10, which is the active part of the lock 30. In FIG. 3, the locking catch 23 is supported on an initial section 16 of the step profile 15. The initial section 16 is located in front of the prelocking stop notch 13 of the catch 10 as seen in the direction of rotation 12. The catch 10 is free at this point. The door 40 can move freely relative to the body of the vehicle.

The catch 10 also cooperates with a closing part 51, which consists, e.g., of a pin, which has a stationary seat in the body of the vehicle. A section 50 of the body is shown schematically in FIG. 3. The catch 10 has a recess 19 for the closing part 51. When the door 40 is open, the closing part 51 is located outside the rotary catch 19. Relative movement between the movable door 40 and the stationary closing part 51 is indicated in FIG. 3 by the arrow 52 on the closing part 51. When this relative movement occurs, the closing part 51 pushes against the long side piece 31 of the U-shaped recess 19 and then exerts a torque on the catch 10, which opposes the spring tension 12 that is acting on the catch. The rotation of the catch 10, which is illustrated in FIG. 3 by an arrow of rotational movement 32, then takes place, by which the catch is moved against its spring tension 12 into a second rotational position 10.2 , which is shown in FIG. 4.

Figure 4:
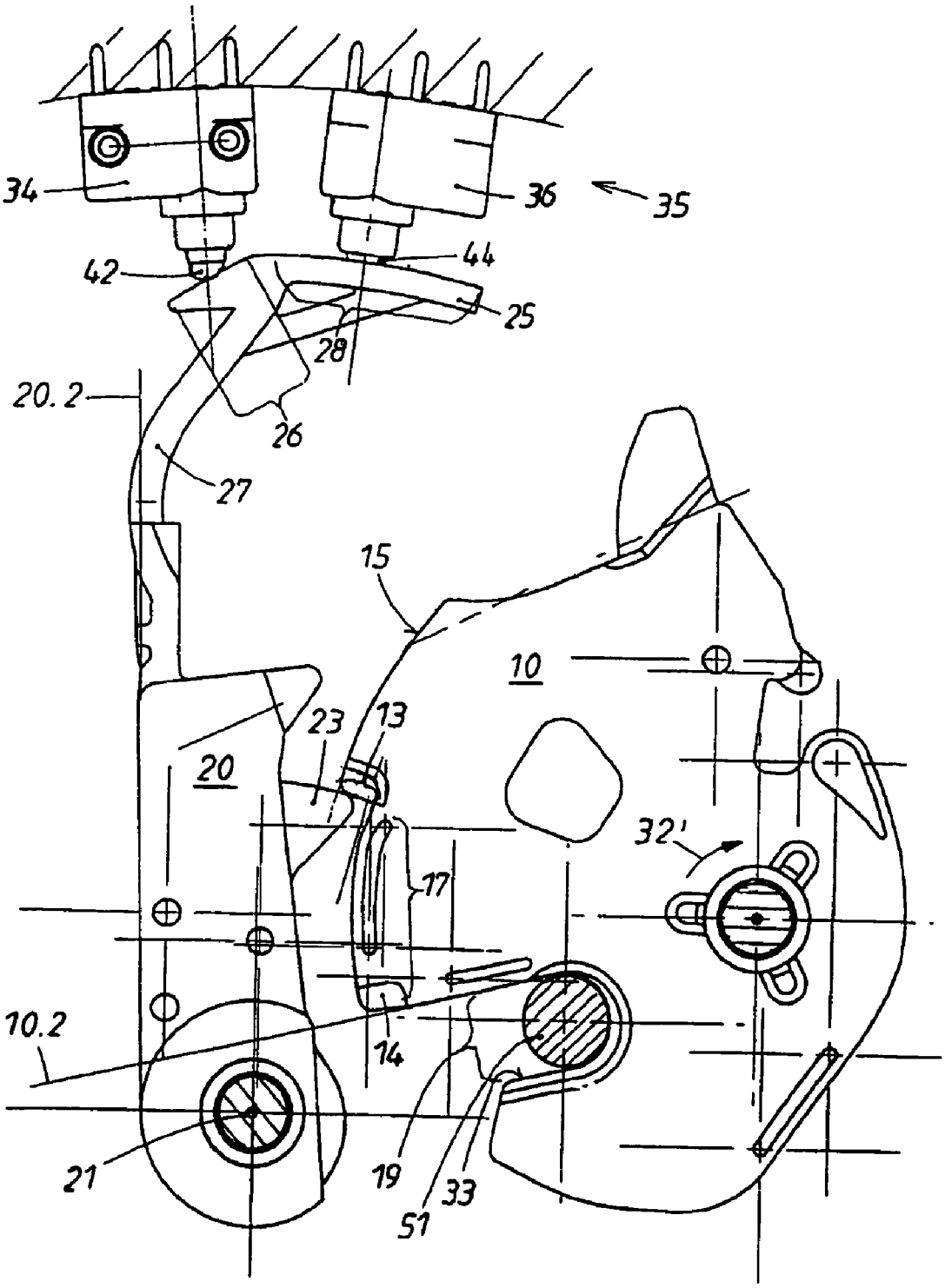
Figure 5:
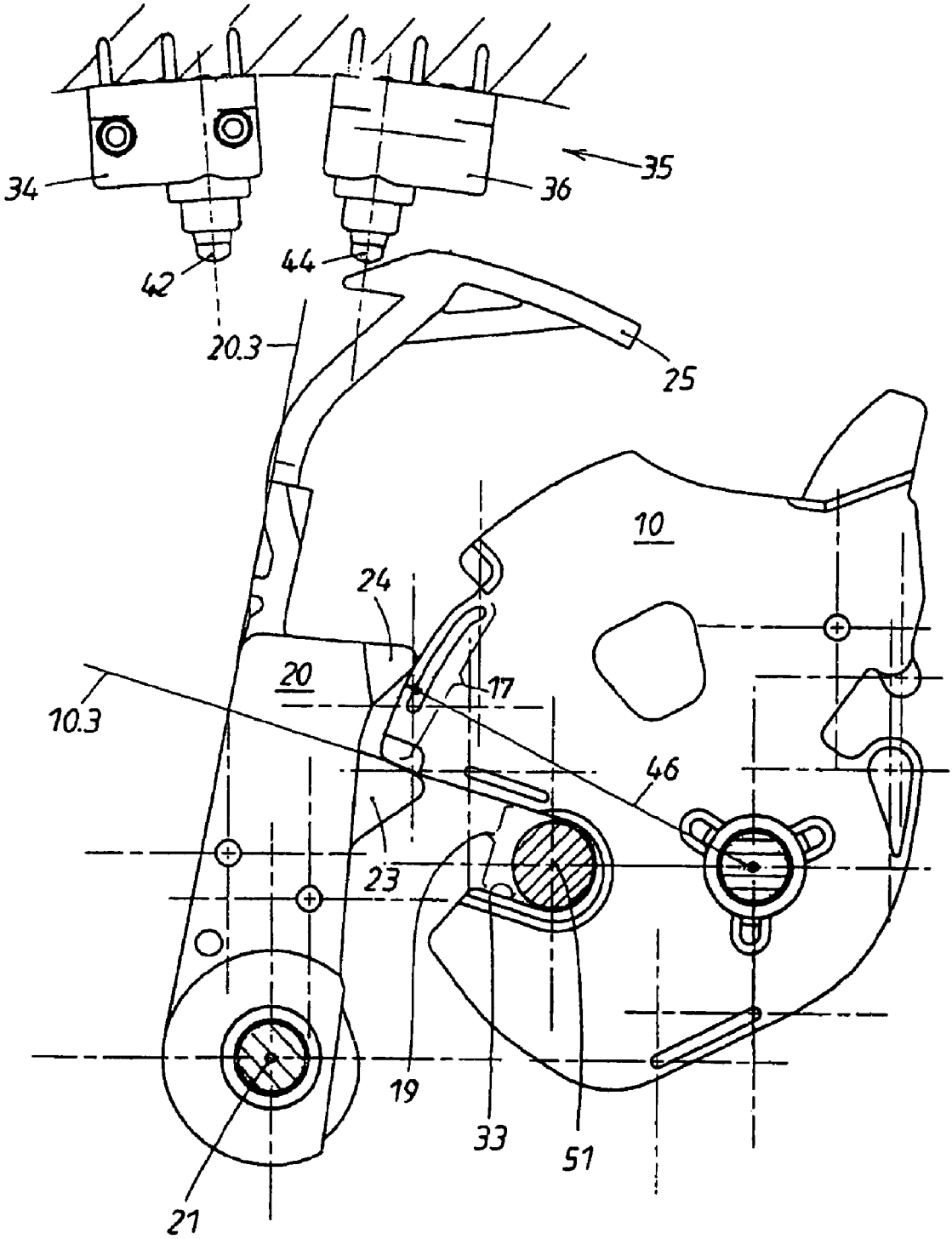

In FIG. 4, the catch 10 is in a prelocking position 10.2 , in which the locking catch 23 of the latch 20 engages behind the aforementioned prelocking stop notch 13 in the step profile 15. The closing part 51 is then already engaged from behind to such an extent by a short side piece 33 of the recess 19 that it is captively grasped. The door is then in a preclosing position with respect to the body of the vehicle. In the prelocking position 10.2 of the catch 10, another section 17 of the step profile 15 is active. This results in the initiation of a specific function in the vehicle, namely, a shutting aid, which transfers the catch 10 to its other rotational position 10.3 , which is shown in FIG. 5 and shall be referred to as the "main lock-in position".

In the main lock-in position 10.3 , the recess has carried the closing part 51 farther along. The locking catch 23 of the latch 20 now engages behind the main stop notch 14 of the step profile 15 of the catch 10. The door is then in its final closed position. The shutting operation initiated in the prelocking position 10.2 ends, because the motorized rotation illustrated by the rotational arrow 32' in FIG. 4 stops. The switching on and switching off of the desired functions as a function of the rotational positions 10.1 to 10.3 of the catch 10 are determined by the aforementioned specially designed step profile 15 of the catch 10, which is monitored directly or indirectly by a sensor 35. The special form of this step profile is shown best in FIG. 1.

Figure 1:
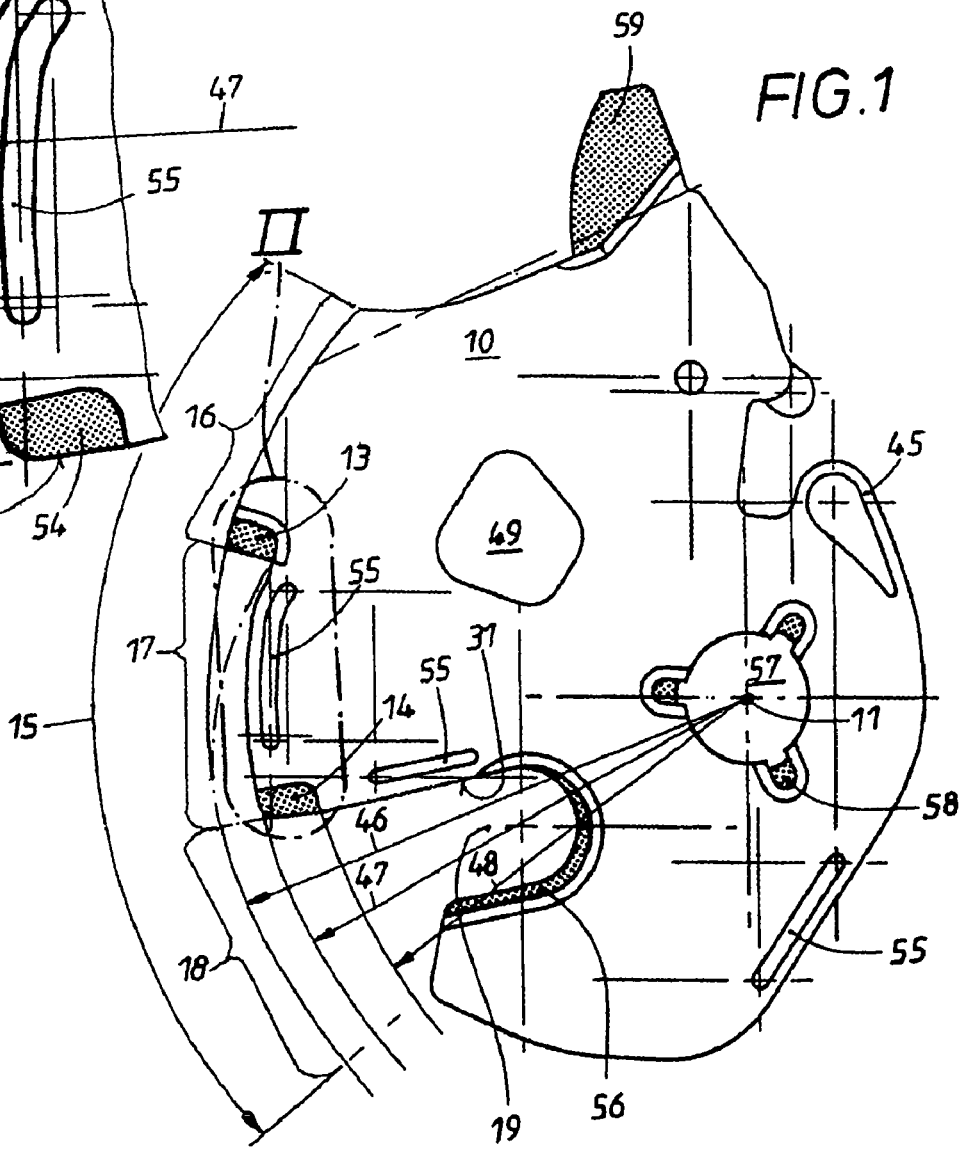
FIG. 1 shows an enlarged top view of a catch of the lock of the invention.

The step profile 15, which is located in the peripheral region of the catch 10, is divided into three profile sections 16 to 18, which, as FIG. 1 shows, have different radial distances 46 to 48 with respect to the axis of rotation 11 of the catch 10. In the open position 10.1 of the catch 10 according to FIG. 3, an initial section 16 of the step profile 15 is the operative section for the latch 20. This initial section 16 has a large radial distance 46 from the axis of rotation 11 of the catch 10, as shown in FIG. 1. This radius 46 is constant over the entire length of the initial section 16.

Figure 2:
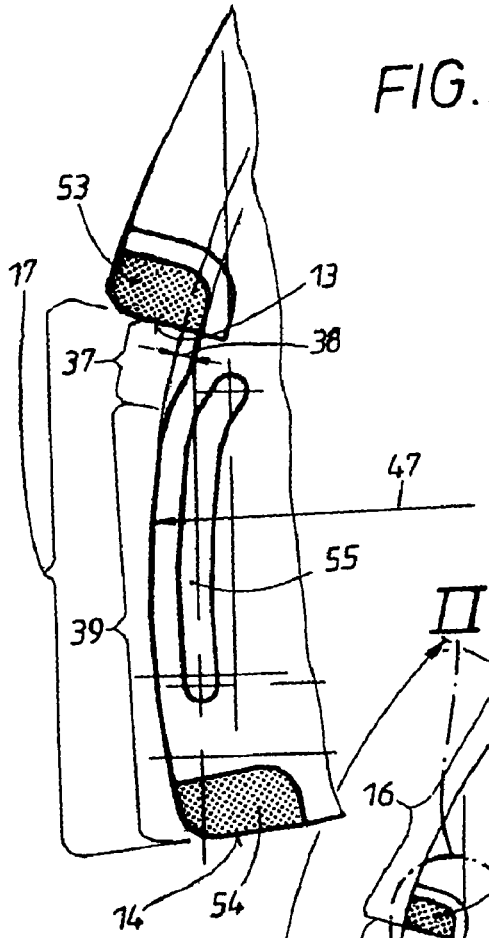
FIG. 2 shows further enlarged detail of FIG. 1 (II in FIG. 1).

In the prelocking position 10.2 of the catch 10 according to FIG. 4, a middle section 17 of the step profile is the operative section for the latch 20. This middle section 17 has a smaller radial distance 47 with respect to the axis of rotation 11 of the catch 10, as shown in FIG. 1. Apart from an initial segment 37, which immediately follows the prelocking stop notch 13 and is shown in FIG. 2, the middle section 17 of the step profile 15 also has a constant radius 17 over its entire length. As the enlarged view in FIG. 2 shows, the initial segment 37 of the middle section 17 has a radius that is smaller by a radial difference 38 than the described radius 47 of the remaining segment 39 of the middle section 17 of the step profile 15. When engagement occurs, this is intended to prevent the free end of the locking catch 23 of the latch 20 from striking the peripheral surface of the profile adjacent to the prelocking stop notch 13. With increasing distance from the prelocking stop notch 13, the reduced radial distance of the initial segment 37 increases continuously until the aforementioned full radial distance 47 is reached in the segment 39 which follows.

As shown in FIG. 1, the main stop notch 14 is followed by an end section 18 of the step profile 15 of the catch 10. The main stop notch 14, which serves as the point of engagement for the latch 20, as shown in FIG. 5, has the smallest radial distance 48, as shown in FIG. 1. As has already been mentioned, the main stop notch 14 is formed by the long side piece 31 of the recess 19, with which the closing part 51 engages during the closing movement 52 of the door, as has already been described and as illustrated in FIG. 3. Due to the recess 19, the radius 48 active at the main stop notch 14 is no longer physically continued. The maximum depth of engagement at the locking catch 23 then determines the aforementioned additional supporting catch 24 of the latch 20. In the main lock-in position 10.3 of FIG. 5, the supporting catch 24 rests at the peripheral radius 46 of the initial section 16.

As has already been mentioned, the different radial distances 46 to 48 are monitored by a sensor 35, which then initiates different functions in the vehicle according to the different rotational positions 10.1 to 10.3 of the catch 10. In the invention, this occurs indirectly via the latch 20, as can be seen in FIGS. 3 to 5 on the basis of its three swivel positions 20.1 to 20.3.

If the open position 10.1 shown in FIG. 3 is present, the latch 20 is in its resting position 20.1. The sensor 35, which is monitoring this, consists in the present embodiment of a pair of contact switches 34, 36, which cooperate with a radial cam 25, which is connected in a rotationally rigid way with the latch 20. The radial cam 25 is mounted on a lengthened arm 27 of the cam.

The two contact switches 34, 36 are fastened on a mount 29 in the lock housing and are connected to an electric control unit 60 (schematically shown in FIG. 3) by their electric connections 41 and 43, respectively by electrical conductors 61-63. The control unit 60 is powered by a power connection 67. The control 60 unit produces the aforementioned desired functions in the vehicle. A contact element 42 that is part of the contact switch 34 interacts with a first cam segment 26 of the radial cam 25, while a contact element 44 of the second switch 36 acts on a second cam segment 28. The second cam segment 28 is essentially a segment of a circular arc with the swivel axis 21 as its center. The first cam segment 26 is angled relative to the second cam segment 28.

In the resting position 20.1 of the latch 20 in FIG. 3, the two contact elements 42, 44 are pushed in. The two contact switches 34, 36 are then in their off position. This "off-off" signal is detected by the control unit and keeps the drive 70 (schematically shown in FIG. 3) of a shutting aid unactivated. In the present case, the shutting aid is desired to carry out the desired function in the vehicle. Consequently, the position 20.2 of the latch 20 can be designated the "initial operating position".

However, if the latch position 20.2 shown in FIG. 4 is present, the first cam segment 26 releases the contact element 42 from the first contact switch 34—due to the altered angular position—while the second contact switch 36 continues to be in its on position. The sensor supplies the signal "on-off" to the control unit. The control unit then switches on the drive 70 for the shutting aid which turns the catch 10 further in the direction of the rotational arrow 32' by a gear mechanism 71 (shown in dot-dash lines in FIG. 3) until the main lock-in position 10.3 of FIG. 5 has been reached.

In FIG. 5, the latch 20 is in a position 20.3 that has swiveled to such an extent that the contact elements 43, 44 of both switches 34, 36 are released by the radial cam 26. The control unit then receives the electric signal "on-on" from the two contact switches 34, 36. The motorized drive of the shutting aid is then stopped. The swivel position 20.3 of the latch 20, which is reached by means of the motorized drive, is thus the "end operating position" for the sensor 35.

As was mentioned earlier, it would also be possible to provide an opening aid, which would be controlled by the sensor 35. To this end, it would be advantageous for this opening aid to have its own release mechanism for lifting out the latch 20 and possibly rotating the catch 10 bank until its open position 10.1 of FIG. 3 has been reached. Turning back of the catch 10 can again take place via the motor drive 70. The latch 20 is then also released and moves into the aforementioned resting position 20.1 of FIG. 3 due to its spring loading 22.

For weight and cost reasons, the catch 10 is constructed as a plastic body, which is provided with elastically yielding loops 45 and slots 55 to reduce noise. The slots 55 conform true to profile to the contour curvature of the catch 10 in the given position and also produce noise-dampening zones there. These zones interact with the latch and thus provide for noise dampening of this interaction.

To ensure dimensional stability and to avoid wear in highly stressed parts of the catch 10, various metallic inserts are incorporated in the plastic, which are emphasized by shading in FIGS. 1 and 2. First and second metallic inserts 53, 54 are located at those points of the catch 10 that function as the prelocking stop notch 13 and the main stop notch 14. Another metallic insert bounds the inner contour of the recess 19 in the catch 10. In addition, to increase the strength, a bearing bore 57 in the catch 10, which determines the axis of rotation 11, is provided with three point metallic inserts. Finally, there is a metallic projection 59 in the peripheral region of the catch 10, which serves to engage certain operating elements (not shown), e.g., the aforementioned shutting aid.

LIST OF REFERENCE NUMBERS 10 catch
10.1 open position (FIG. 3)

10.2 prelocking position of 10 (FIG. 4)
10.3 main lock-in position of 10 (FIG. 5)
11 rotary catch of 10
12 force arrow of the spring loading of 10 (FIG. 3)
13 prelocking stop notch on 10
14 main stop notch on 10
15 step profile on 10
16 initial section of 15
17 middle section of 15
18 end section of 15
19 recess for 51 in 10
20 latch
20.1 resting position of 20 (FIG. 3)
20.2 initial operating position (FIG. 4)
20.3 end operating position of 20 (FIG. 5)
21 swivel axis of 20
22 force arrow of the spring loading of 20 (FIG. 3)
23 locking catch of 20
24 supporting catch of 20
25 radial cam on 20
26 first cam segment of 25 (FIG. 3)
27 lengthened arm of 20 for 25 (FIG. 3)
28 second cam segment of 25 (FIG. 3)
29 mount for 34, 36 (FIG. 3)
30 lock (FIG. 3)
31 long side piece of 19 (FIG. 3)
32 arrow of the mechanical rotary movement of 10 (FIG. 3)
32' arrow of the motorized rotary movement of 10 (FIG. 4)
33 short side piece of 19 (FIG. 4)
34 first contact switch of 35
35 sensor comprising 34, 36
36 second contact switch of 35
37 initial segment in 17 (FIG. 2)
38 radial difference between 37 and 39 (FIG. 2)
39 remaining segment of 17 (FIG. 2)
40 moving part of the vehicle, section of the door (FIG. 3)
41 electrical connection to 34 (FIG. 3)
42 contact element of 34 (FIG. 3)
43 electrical connection to 36 (FIG. 3)
44 contact element of 36 (FIG. 3)
45 elastic loop on 10 (FIG. 1)
46 radial distance of 16, radius (FIG. 1)
47 radial distance of 17, radius (FIG. 1)
48 radial distance of 18, radius (FIG. 1)
49 opening in 10 (FIG. 1)
50 stationary part of the vehicle, section of the vehicle body (FIG. 3)
51 closing part on 50 (FIG. 3)
52 arrow of the closing movement of 51 towards 30 (FIG. 3)
53 metallic insert or 13 in 10 (FIG. 2)
54 metallic insert or 14 in 10 (FIG. 2) slot in 10 (FIG. 1)
56 metallic contour for 19 in 10 (FIG. 1)
57 bearing bore for 11 (FIG. 1)
58 point metallic insert in 57 (FIG. 1)
59 metallic projection on 10 (FIG. 1)
60 control device (FIG. 3)
61 conductor between 41 and 60 (FIG. 3)
62 conductor between 41 and 60 (FIG. 3)
63 conductor between 41 and 60 (FIG. 3)
64 conductor between 43 and 60 (FIG. 3)
65 conductor between 43 and 60 (FIG. 3)
66 conductor between 43 and 60 (FIG. 3)
67 power connection for 60 (FIG. 3)
68 connection line between 60 and 70 (FIG. 3)
70 motor drive of 10 (FIG. 3)
71 drive mechanism between 70 and to (FIG. 3)

The invention claimed is:

1. A lock mechanism between a moving part of a vehicle, the moving part being a door (40) or hinged lid on the vehicle, and a stationary part of a vehicle, namely, the vehicle body (50), which consists of a lock (30) on one part (40) of the vehicle and a closing part (51) on the other part (50) of the vehicle, where the lock (30) comprises a rotatable supported (11) catch (10) and a swiveling (21) latch (20) that is spring-tensioned (22) towards the catch (10), the catch (10) has a recess (19) for the closing part (51), a periphery having a profile (15) with a prelocking stop notch (13), and a main stop notch (14) for a locking catch (23) on the latch (20), and can be moved among at least three rotational positions (10.1 to 10.3), namely, an open position (10.1) of the catch (10), in which the closing part (51) can be moved in or out (52) of the recess (19), the latch (20) is supported by its locking catch on an initial section (16) of the profile (15) that is located before the main stop notch (14) and the prelocking stop notch (13), and the door (40) can move freely, a prelocking position (10.2), in which the closing part (51) is captively grasped by the recess (19), the locking catch (21) of the latch (20) engages the prelocking stop notch (13) in the profile (15) from behind, and the door (40) is in a preclosing position, and a main lock-in position (10.3), in which the closing part (51) of the catch (10) has been carried farther along, the locking catch (51) of the latch (20) engages the main stop notch (14) of the profile (15) from behind, and the door (40) has been brought into its final closed position, wherein the catch (10) has a larger radial distance (46, 47), relative to the axis of rotation (11), at the prelocking stop notch (13) than the radial distance (47, 48) at the main stop notch (14), so that at the periphery of the catch (10) there is a step profile (15), wherein due to the difference (46, 47; 47, 48) in the radial distance, the latch (20) assumes three different swivel positions (20.1-20.3) in the three rotational positions (10.1-10.3) of the catch (10), namely, a resting position (20.1) in the open position (10.1) of the catch (10), an initial operating position (20.2) in the prelocking position (10.2), and an end operating position (20.3) in the main lock-in position of the catch (10), wherein the latch (20) directly engages a sensor (35) and is the only actuator of the sensor (35) so that in response to actuation the sensor determines the actual one of the three swivel positions (20.1-20.3) of the latch (20) and signals a control unit, wherein, based on the signals from the sensor, the control unit determines the actual rotational position (10.1-10.3) of the catch (10) and carries out a certain function in the vehicle.

2. A lock mechanism in accordance with claim 1, wherein the segment of the catch (10) that is located in front of the prelocking stop notch (13) has a greater radius (46) than the segment of the catch (10) that is located behind the prelocking stop notch (13).

3. A lock mechanism in accordance with claim 1, wherein the control unit activates and/or inactivates a motorized shutting aid and/or a motorized opening aid.

4. A lock mechanism in accordance with claim 1, wherein the initial section (16) of the step profile (15) of the catch (10) serves to support the locking catch (23) of the latch (20) in the open position (10.1) and has a radial distance (46) to the axis of rotation (11) of the catch (10) that is different from both the radial distance (47) of the prelocking stop notch (13) and the radial distance (48) of the main stop notch (14)

where this radial distance (46) is also monitored by a sensor (35) and signaled to the control unit.

5. A lock mechanism in accordance with claim 1, where the sensor (35) for monitoring the prelocking position (10.2) and the main lock-in position (10.3) is the same sensor that determines the open position (10.1).

6. A lock mechanism in accordance with claim 5, wherein the sensor (35) consists of a pair of contact switches (34, 36), which are connected to the control unit, where both contact switches (34, 36) together uniquely determine the three rotational positions (10.1 to 10.3) of the catch (10) for the control unit by variation of their switching state (on or off).

7. A lock mechanism in accordance with claim 1, wherein a middle section (17) of the step profile (15) of the catch (10) is located between the prelocking stop notch (13) and the main stop notch (14) of the catch (10)

where the whole middle section (17) has an essentially constant radial distance (47) from the axis of rotation (11) of the catch (10).

8. A lock mechanism in accordance with claim 7, wherein the middle section (17) of the catch (10) is provided with a slot (55) in the border region towards the periphery, which dampens noise when the latch (20) falls into a prelocking stop notch (13) of the catch (10).

9. A lock mechanism in accordance with claim 1, wherein the entire initial section (16) of the step profile (15) that is present in the open position (10.1) of the catch (10) and extends to the prelocking stop notch (13) of the catch (10) has an essentially constant radial distance (46) to the axis of rotation (11) of the catch (10).

10. A lock mechanism in accordance with claim 7, wherein an end section (18) of the step profile (15), which interacts with the latch (20) in the main lock-in position (10.3) of the catch (10), has the smallest radial distance (48) from the axis of rotation (11) of the catch where the middle section (17) of the step profile (15) has an intermediate radial distance (47) from the axis of rotation (11), and the initial section (16) has a large radial distance (46) from the axis of rotation (11).

11. A lock mechanism in accordance with claim 7, wherein the middle section (17) of the profile (15) has an initial segment (37), which directly follows the prelocking stop notch (13) and has a radial distance that is initially reduced from the radial distance of a remaining segment (39) of the middle section (17) of the profile (15) by a radial difference (38).

12. A lock mechanism in accordance with claim 11, wherein the radial distance of the initial segment (37) increases continuously with increasing distance from the prelocking stop notch (13) until the radial distance (47) of the remaining segment (39) of the middle section (17) of the profile (15) is reached.

13. A lock mechanism in accordance with claim 11, wherein the recessed initial segment (37) of the middle section (17) of the step profile (15) prevents the end of the locking catch (23) from striking when the latch is supported on the prelocking stop notch (13) of the catch (10).

14. A lock mechanism in accordance with claim 1, wherein the main stop notch (14) is formed by one of the side pieces (31) of the recess (19) in the catch (10), into which the closing part (51) moves during the closing operation (52) of the door (40)

where, besides the locking catch (23), the latch (20) has a supporting catch (24), which is supported on the initial section (16) of the step profile (15) in the main lock-in position (10.3) of the catch (10) and limits the depth of penetration of the latch (20) into the catch (10).

15. A lock mechanism in accordance with claim 1, wherein a radial cam (25) is connected in a rotationally rigid way with the latch (20), where the radial cam (25) is sensed by the sensor (35)

and where, when the latch (20) swivels among the three swivel positions (20.1 to 20.3), the radial cam (25) is swiveled with it and changes its position relative to the sensor (35).

16. A lock mechanism in accordance with claim 15, wherein the radial cam (25) is located on a lengthened arm (27) of the latch (20) and where the sensor (35) is mounted in a stationary way in the path of the swiveling movement of the radial cam (25) that is obtained during the transition of the latch (20) between the resting position (20.1) and the end operating position (20.3).

* * * * *